US009415391B2

(12) United States Patent
Kimura et al.

(10) Patent No.: US 9,415,391 B2
(45) Date of Patent: Aug. 16, 2016

(54) CARTRIDGE FOR BIOCHEMICAL USE AND BIOCHEMICAL PROCESSING DEVICE

(71) Applicant: Hitachi High-Technologies Corporation, Tokyo (JP)

(72) Inventors: Ryusuke Kimura, Tokyo (JP); Hiromi Yamashita, Tokyo (JP); Motohiro Yamazaki, Tokyo (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 14/416,084

(22) PCT Filed: Jun. 18, 2013

(86) PCT No.: PCT/JP2013/066655

§ 371 (c)(1),
(2) Date: Jan. 21, 2015

(87) PCT Pub. No.: WO2014/017219

PCT Pub. Date: Jan. 30, 2014

(65) Prior Publication Data

US 2015/0151295 A1 Jun. 4, 2015

(30) Foreign Application Priority Data

Jul. 23, 2012 (JP) ..... 2012-162465

(51) Int. Cl.
*B01L 3/00* (2006.01)

(52) U.S. Cl.
CPC ..... *B01L 3/50273* (2013.01); *B01L 3/502715* (2013.01); *B01L 3/502723* (2013.01); *B01L3/502738* (2013.01); *B01L 2200/0605* (2013.01); *B01L 2300/087* (2013.01); *B01L 2300/0867* (2013.01); *B01L 2300/0874* (2013.01); *B01L 2300/123* (2013.01); *B01L 2400/0481* (2013.01); *B01L 2400/0655* (2013.01)

(58) Field of Classification Search
CPC ..... F04B 43/02; F04B 43/021; F04B 43/028; F04B 43/0043; F04B 43/0054; B01L 3/50273; B01L 3/502723; B01L 3/502738; B01L 3/502715; B01L 2200/0605; B01L 2300/0867; B01L 2300/087; B01L 2300/0874; B01L 2300/123
See application file for complete search history.

(56) References Cited

U.S. PATENT DOCUMENTS

2004/0209354 A1 10/2004 Mathies et al.
2005/0250145 A1 11/2005 Hirabayashi et al.

(Continued)

FOREIGN PATENT DOCUMENTS

| | | |
|---|---|---|
| EP | 1867733 | 12/2007 |
| JP | 63-315956 | 12/1988 |
| JP | 2005-318834 | 11/2005 |
| JP | 2008-508876 | 3/2006 |

(Continued)

OTHER PUBLICATIONS

International Search Report in PCT/JP2013/066655, dated Sep. 3, 2013.

*Primary Examiner* — Brian R Gordon
(74) *Attorney, Agent, or Firm* — Mattingly & Malur, PC

(57) ABSTRACT

A cartridge sealed from an external air is used to enable mixing with a reagent, agitating, purification, reaction, etc. Provided inside the cartridge sealed from the external air are a chamber for the reagent to be transported, a chamber to which the reagent is transported, and the chambers are connected by a liquid transport channel. A groove is made in a cartridge body and a membrane as an elastic body is pasted onto the groove to form the liquid transport channel. Air pressure is given to the membrane to change the volume of the liquid transport channel and thereby move the fluid inside. The inlet of each chamber has a valve function to move the fluid inside in a desired direction according to change of the liquid transport channel. This enables transportation of the liquid inside the cartridge sealed from the external air.

14 Claims, 13 Drawing Sheets

(56) References Cited

U.S. PATENT DOCUMENTS

| | | | | |
|---|---|---|---|---|
| 2006/0030796 | A1 | 2/2006 | Xu et al. | |
| 2013/0130262 | A1 * | 5/2013 | Battrell | B01L 3/50273 435/6.12 |

FOREIGN PATENT DOCUMENTS

| | | |
|---|---|---|
| JP | 2006-512092 | 4/2006 |
| JP | 2007-330179 | 12/2007 |
| JP | 2011030522 | 2/2011 |

* cited by examiner

CARTRIDGE FOR BIOCHEMICAL USE AND BIOCHEMICAL PROCESSING DEVICE

TECHNICAL FIELD

The present invention relates to cartridges for biochemical use and biochemical processing devices which are used to extract a living substance by biochemical reaction and conduct synthesis and analysis as necessary.

BACKGROUND ART

For example, in order to conduct gene analysis, various biochemical processes and reactions, such as extraction and amplification of nucleic acids such as DNA and RNA from a sample (also called an analyte or specimen) obtained from a living thing or the like, are needed. For these processes and reactions, several reagents must be accurately mixed with the sample. When various reagents are put in the sample and various biochemical processes are carried out, the reagents must be transported to various processing cells.

As a method for mixing a reagent with a sample, a pipette system based on a dispensing robot is often used in automatic analyzing devices, etc. as described in Patent literature (PTL) 1. A dispensing robot is a unit which drives a dispensing mechanism two-dimensionally or three-dimensionally within a given area of the device and automatically sucks in and discharges a liquid through a nozzle, tip or the like at the tip of the dispensing mechanism.

On the other hand, in the field of gene analysis, there is a DNA amplifying process called PCR reaction (Polymerase Chain Reaction). In the field of gene analysis, DNA to become a template must be amplified by PCR reaction until a detector can detect it and this is known as a very effective method.

When handling DNA or RNA, it is necessary to prevent non-target DNA or RNA from getting mixed (hereinafter referred to as contamination). PCR may amplify a minute trace (one molecule) of DNA as a template. Therefore, it is necessary to prevent low-molecular clone DNA or DNA fragments (PCR product) amplified by PCR from being contaminated and becoming a template. To this end, a chamber in which DNA as a target of extraction, etc. is handled and a chamber in which PCR is conducted should be separated, and DNA aerosol contamination should be prevented by transporting a sample through a tube containing the sample, and PCR reaction should be conducted under a clean bench.

In the case of the pipette system which uses a dispensing robot as described in PTL 1, contamination is prevented by cleaning the nozzle or throwing away the tip. However, since the nozzle or tip moves in the air, it is very difficult to prevent DNA aerosol contamination. For this reason, the chamber in which DNA is handled and the chamber in which PCR is conducted are separated and work is done under a clean bench to reduce contamination as far as possible.

In recent years, researches have been promoted in which a sample is reacted with a reagent in a microspace using a microdevice to perform a series of processes including extraction, purification, amplification, and analysis of a living substance. A microdevice may be used for a wide variety of applications including gene analysis. The use of a microdevice offers the following advantages: consumption of samples and reagents is smaller than with an ordinary device; it is easier to carry than when various reagents are set; and it is disposable. In addition, since reaction in a small device is completed in an enclosed space, it is considered to address the above problem of contamination easily. PTL 2 proposes a technique of extracting DNA using a preprocessing tip as an example of application of a microdevice.

CITATION LIST

Patent Literature

[PTL 1] Japanese Patent Application Laid-Open No. S63 (1988)-315956

[PTL 2] Japanese Patent Application Laid-Open No. 2007-330179

SUMMARY OF INVENTION

Technical Problem

In order to mix small amounts of reagent and sample to conduct chemical reaction and analysis in a microdevice, quantitative control of fluids such as the reagent and sample in the microdevice is important. The reason is that chemical reaction and analysis cannot be made as expected unless appropriate amounts of reagent and sample are transported at an appropriate time. Therefore, the flow rate, flow velocity, fluid pressure, etc. of the fluid to be transported must be controlled properly.

As methods for transporting liquids in a microdevice, there are a centrifugal method and a method in which air pressure is encapsulated directly in a flow channel. In the both methods, it is difficult to transport liquids under a condition sealed from the external air, so there is concern about the possibility of DNA aerosol contamination. In addition, it is difficult to control the fluid flow rate and fluid transporting time.

The present invention intends to provide a disposable cartridge for biochemical use which solves the above problem, is shielded from the external air, and enables easy flow rate control of liquids such as reagents, as well as a biochemical processing device using the same.

Solution to Problem (1) A cartridge for biochemical use according to the present invention includes a chamber as a liquid transport source for encapsulating a reagent to be transported, a chamber as a liquid transport destination for the reagent, and a liquid transport channel for connecting them, in which these chambers and the liquid transport channel are sealed in a cartridge body, the liquid transport channel is formed and an elastomer membrane is pasted on the bottom of the cartridge body, and part of the membrane is one wall surface of the liquid transport channel and constitutes a pneumatic diaphragm pump mechanism which reciprocates according to change in pressure given from outside and changes the volume of the liquid transport channel.

For example, the cartridge for biochemical use includes a chamber for encapsulating a liquid sample, a chamber for encapsulating a reagent, and a plurality of chambers in which a series of processes for extracting and purifying a living substance as a target from the mixed liquid as the liquid sample mixed with the reagent are performed sequentially. Also it includes a liquid transport channel which connects mutually related chambers among these chambers. These chambers are sealed in the cartridge body. On the bottom of the cartridge body, the liquid transport channel is formed and a membrane as an elastomer is pasted. Part of the membrane is one wall surface of the liquid transport channel and constitutes a pneumatic diaphragm pump mechanism which reciprocates according to change in pressure given from outside and changes the volume of the liquid transport channel.

(2) A biochemical processing device according to the present invention includes the following constituent elements in addition to the cartridge for biochemical use: namely a cartridge holder which holds the cartridge and has an air pressure applying part to apply air pressure to activate the membrane as the pump mechanism; and an air supply/exhaust mechanism connected to an air pressure source to control supply of the air pressure to the cartridge holder and exhaust thereof.

Advantageous Effects of Invention

According to the cartridge for biochemical use in the present invention described above in (1), in a closed space, a reagent and a sample can be transported in a noncontact manner and biochemical processing can be performed, so contamination can be prevented.

According to the biochemical processing device in the present invention described above in (2), the air supply/exhaust mechanism for driving the valve mechanism to open and close the liquid transport port of each chamber of the cartridge and the air pressure applying part for activating the liquid transport pump mechanism (membrane) of the cartridge are located in the cartridge holder, so the size and cost of the cartridge can be reduced.

DESCRIPTION OF EMBODIMENTS

Next, embodiments of the present invention will be described by taking an example, referring to drawings.

Figure 1:
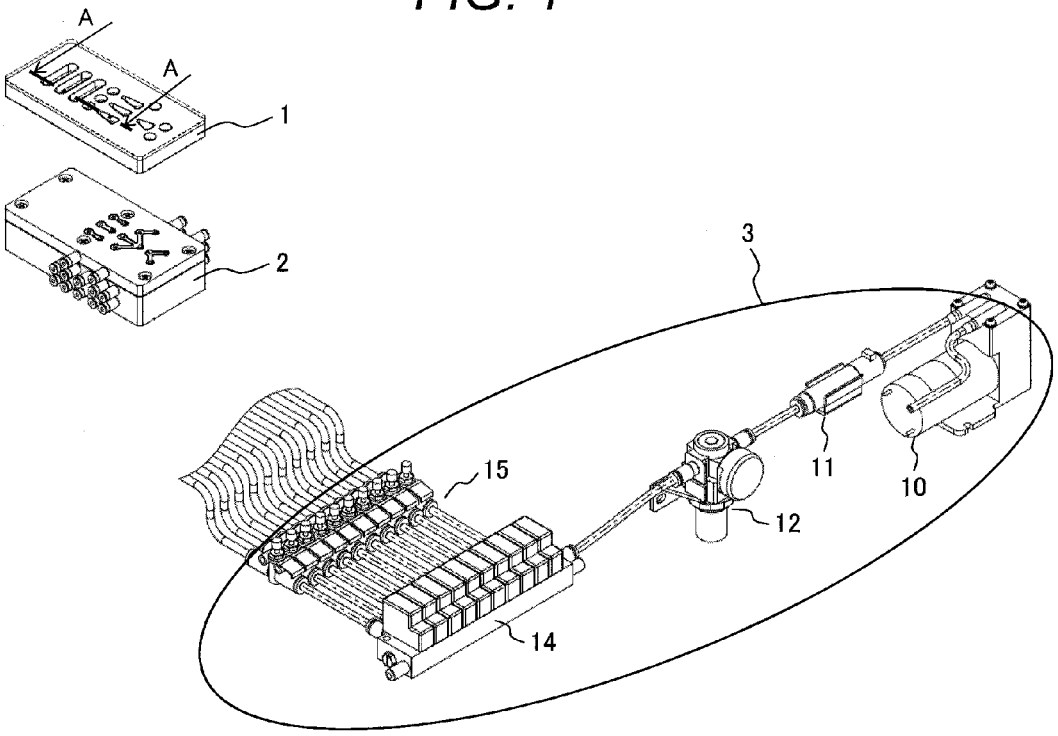
FIG. 1 is a partially omitted perspective view showing the general structure of a biochemical processing device according to an embodiment of the present invention.

The biochemical processing device according to an embodiment of the present invention as shown in FIG. 1 exemplifies a device which performs a series of processes from extraction of DNA to its amplification as an example of nucleic acid extraction and amplification. The biochemical processing device includes three units: a cartridge 1 for biochemical use which performs the above series of processes in a closed condition; a cartridge holder 2 which holds the cartridge 1 and has an air pressure applying part to open and close the liquid transport channel of the cartridge 1 and enable the cartridge 1 to perform pumping operation; and an air pressure control system 3 which is connected to an air pump (air pressure source) 10 and controls supply of air pressure to the cartridge holder 2 and exhaust thereof.

Figure 17:
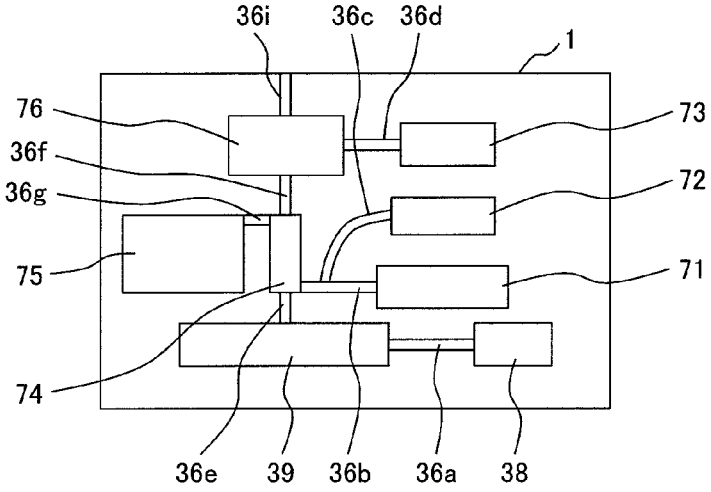
FIG. 17 is a plan view showing the general structure of the cartridge.

First, the general structure of the cartridge 1 as an example is described, referring to FIG. 17. FIG. 17 is a plan view showing the outline of the cartridge 1.

The cartridge 1 includes a sample encapsulating chamber 39 for encapsulating a liquid specimen (hereinafter called a sample) including a living substance; reagent encapsulating chambers for encapsulating various reagents (for example, a solution encapsulating chamber 38 for encapsulating a solution for nucleic acid extraction, a cleaning liquid encapsulating chamber 71 for encapsulating a cleaning liquid, an eluent encapsulating chamber 72 for encapsulating an eluent, and an amplifying reagent encapsulating chamber 73 for encapsulating an reagent for PCR amplification); a plurality of chambers in which a series of processes to extract and purify a living substance (DNA in this example) as a target from a mixed liquid as a mixture of a liquid sample and a reagent are performed (for example, a agitating chamber, a living substance adsorbing chamber 74, and a waste liquid chamber 75); a chamber 76 for nucleic acid amplification; and liquid transport channels 36 (36*a* to 36*g*). In each liquid transport channel 36, when the liquid transport port provided in the corresponding chamber is opened by a valve mechanism (which will be described later), the liquid can circulate and a pump mechanism (which will be described later) is used for this circulation. In the explanation give below, the liquid transport channels 36*a* to 36*g* enable the liquid to flow in a related process and while the liquid is flowing, the relevant liquid transport channel is held open by the valve mechanism and the other liquid transport channels are closed by the valve mechanism.

In this embodiment, the sample encapsulating chamber 39 also serves as a chamber for introducing a reagent (solution) from the reagent encapsulating chamber (solution chamber) 38 through the liquid transport channel 36*a* and preparing a mixed liquid. Furthermore, it also serves as a chamber for agitating the mixed liquid. Agitating will be described later. Alternatively the chamber for preparing a mixed liquid and the chamber for agitating may be provided separately from the sample encapsulating chamber 39.

In the sample encapsulating chamber 39, the nucleic acid in the sample is exposed by a solution (dissolution step) and after the dissolution step, the mixed liquid is introduced from the sample encapsulating chamber 39 through the liquid transport channel 36*e* into the living substance adsorbing chamber 74, where the target nucleic acid is made to adsorb onto the surface of a carrier provided in the adsorbing chamber 74 (adsorption step).

The mixed liquid introduced into the adsorbing chamber 74 is transported through a liquid transport channel 36*g* to the waste liquid chamber 75. After the adsorption step, the cleaning liquid is transported from the cleaning liquid encapsulating chamber 71 through the liquid transport channel 36*b* to the adsorbing chamber 74 and the components other than the nucleic acid as the target on the carrier surface are cleaned (cleaning step). The waste cleaning liquid is guided through the liquid transport channel 36*g* into the waste liquid chamber 75. After the cleaning step, the eluent from the eluent encapsulating chamber 72 is transported through the liquid transport channel 36*c* to the adsorbing chamber 74. Consequently, the nucleic acid adsorbed on the carrier surface leaves the carrier and is transported through the liquid transport channel 36*f* to the reaction chamber 76 for nucleic acid amplification together with the eluent (elution step: nucleic acid extraction). After that, the reagent required for PCR amplification is transported from the amplifying reagent encapsulating chamber 73 through the liquid transport channel 36*d* to the reaction chamber 76. The reagent required for PCR amplification is a mixture of primer, Taq polymerase and nucleotide (dNTP) with a buffer solution and this is mixed with the eluent containing the above extracted nucleic acid (template DNA) to become a reaction solution.

The reaction solution in the reaction chamber 76 is temperature-controlled by a thermal cycler (not shown) built in the cartridge holder 2 to perform nucleic acid amplification by the PCR method. After the nucleic acid amplification step, the reaction solution is transported through a capillary tube (not shown) connected to the liquid transport channel 36*i* and the cartridge 1 to a capillary electrophoresis DNA sequencer (not shown) where DNA analysis takes place.

Next, the structures of the cartridge 1 and cartridge holder 2 will be described referring to FIGS. 4 to 6.

Figure 4:
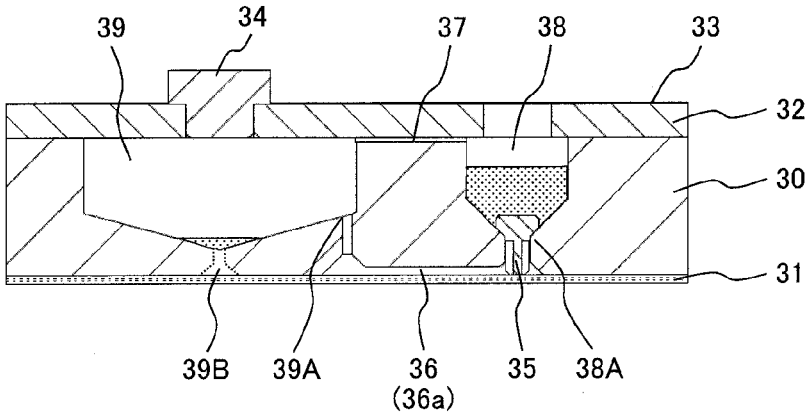
FIG. 4 is a longitudinal sectional view of a cartridge for biochemical use used in the above embodiment.

FIG. 4 is a longitudinal sectional view of the cartridge 1 (taken along the line A-A in FIG. 1), showing the reagent encapsulating chamber (solution encapsulating chamber) 38, the sample encapsulating chamber 39, and the liquid transport channel 36 (36*a*). The abovementioned other chambers 71 to 76 and liquid transport channels 36*b* to 36*g* are similar to the chambers and liquid transport channel as shown in FIG. 4 in terms of the relation between a chamber and a liquid transport channel, so their cross section structures are omitted.

As shown in FIG. 4, in the cartridge 1, the cartridge body 30 has the reagent encapsulating chamber 38, the sample encapsulating chamber 39, and a groove to become the liquid transport channel 36*a* which connects these chambers. The groove 36*a* is formed on the bottom of the cartridge body 30. A membrane 31 is pasted on the bottom of the cartridge body 30. Part of this membrane 31 serves as one face of the liquid transport channel 36*a* and constitutes a pump mechanism which reciprocates according to change in the pressure given from outside to change the volume of the liquid transport channel.

The reagent (solution) required to process the sample is previously encapsulated in the reagent encapsulating chamber 38. In the other various reagent encapsulating chambers 71, 72, and 73 as well, the respective reagents are encapsulated similarly. In order to prevent the reagent from flowing to the liquid transport channel 36 (liquid transport channel 36*a* in FIG. 4) during storage, a plug 35 is provided at the liquid transport port 38A between the reagent encapsulating chamber (solution encapsulating chamber 38 in FIG. 4) and the liquid transport channel 36*a*. Between the chambers, a very small vent groove (or vent hole) 37 is provided above the chambers. A top cover 32 is attached to the cartridge body 30 so as to cover the chambers and vent groove 37 and a film 33 is pasted on the top cover 32 to make the inside of the cartridge 1 sealed. The vent groove 37 has a function to make the pressure level equal between the chambers and ensure that circulation in the liquid transport channel 36 and reciprocating motion of the membrane 31 are smooth.

As shown in FIG. 17, the sample encapsulating chamber 39 is connected to the adsorbing chamber 74 through the liquid transport channel 36*e* and as shown in FIG. 4, a liquid transport port 39B as one upstream end of the liquid transport channel 36*e* is also provided at the exit of the sample encapsulating chamber 39. A plug (not shown) similar to the plug 35 provided at the liquid transport port 38A is provided at the liquid transport port 39B as well.

Taking mass production into consideration, it is desirable that the components used in the cartridge 1 be made of a mold-formable material. It is desirable that the cartridge body 30 is made of acrylic resin, polycarbonate resin, quartz or the like and the membrane 31 be made of heat-resistant and weather-resistant silicon rubber, PDMS or the like. It is manufactured by pasting these together chemical treating or with an adhesive agent or double-faced tape. The top cover 32 is made of the same material as the cartridge body 30 and the inside of the cartridge 1 is sealed by ultrasonic welding of the peripheries of the chambers.

In the cartridge 1, various reagents are previously encapsulated in the chambers and the cartridge 1 is supplied to the user as it is. On the other hand, the user has to encapsulate a sample in the sample encapsulating chamber 39. In doing so, the user removes the rubber plug 34 attached to the top cover 32 of the cartridge 1, puts the sample in it, reattaches the rubber plug 34 to seal the sample encapsulating chamber 39.

Figure 5:
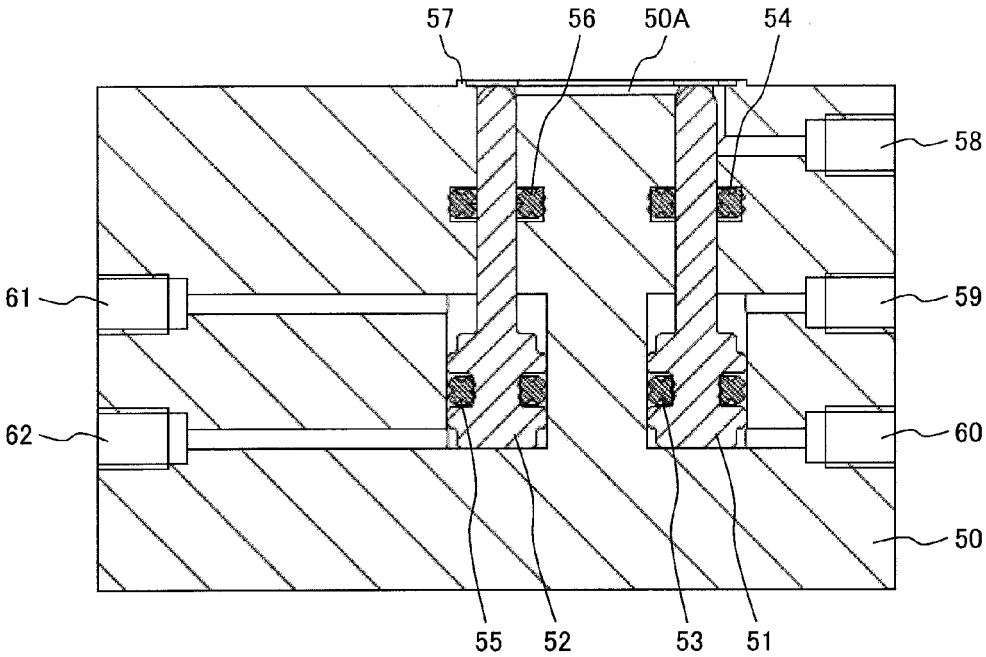
FIG. 5 is a longitudinal sectional view of a cartridge holder used in the above embodiment.

FIG. 5 is a sectional view of the cartridge holder 2, taken along the line A-A in FIG. 1, which corresponds to the cartridge 1 in FIG. 4. It shows, as an example, an air cylinder mechanism to open and close the reagent encapsulating chamber 38 and sample encapsulating chamber 39 shown in FIG. 4 and an air supply/exhaust mechanism for air pressure to drive the membrane (liquid transport pump). Though not shown in FIG. 4, the air supply/exhaust mechanism and air cylinder mechanism for the other chambers and liquid transport channels are also provided in the cartridge body 30 in the same way as shown in FIG. 4. Next, the air cylinder mechanism and air supply/exhaust mechanism will be described.

In the cartridge holder 2, a cartridge holder body 50 has an air cylinder mechanism and an air supply/exhaust mechanism which are driven by the air pressure control system 3 when the cartridge 1 is loaded, as shown in FIGS. 6 to 16.

The air cylinder mechanism includes a plurality of pin-like plungers (plungers 51 and 52 are shown in FIGS. 5 to 16) which are built in the cartridge holder body 50 and activated by change in air pressure, and air pressure ports (air pressure ports 58 to 62 are shown in FIGS. 5 to 16) which introduce the air pressure to be applied to these plungers. The air pressure is, for example, positive pressure but it may be negative pressure. The plunger 51 deforms part of the membrane 31 elastically to open and close the liquid transport port 38A of the reagent encapsulating chamber 38. The plunger 52 deforms part of the membrane 31 elastically to open and close the liquid transport port 39A. Therefore, part of the membrane 31 works as a valve which is activated by the air cylinder mechanism. Gaskets 53 and 55 are fitted to the bases of the plungers 51 and 52 respectively. Gaskets 54 and 56 are also fitted near the top ends of the plungers 51 and 52. Also, the cartridge holder body 50 has a sealing projection 57 on its top surface to crush part of the membrane 31 and seal the surroundings of the liquid transport channel 36 of the cartridge 1 when the cartridge 1 is loaded. Since the air pressure ports 58 to 62 are connected to the corresponding three-way valves 14 of the air pressure control system 3 respectively, the plungers 51 and 52 can be separately controlled.

Preferably the cartridge holder body 50 should be made of acrylic resin. The larger the number of liquid transport points in the cartridge 1 is, the more complicated the air pressure flow path of the cartridge holder body 50 is. If it is made of acrylic resin, joining or bonding can be done, so the problem of a complicated flow path can be addressed. Since the number of cylinders in the air cylinder mechanism increases with increase in the number of liquid transport points, preferably it should be made of a rigid resin such as PPS resin. However, if it is made by molding, air leakage from a parting line may occur, and care must be taken not to cause such leakage. As gaskets for pneumatic reciprocation, the gaskets 53, 54, 55, and 56 have vacuum grease coated on their sliding parts. Consequently, sliding friction is reduced when the plungers 51 and 52 are driven.

Figure 6:
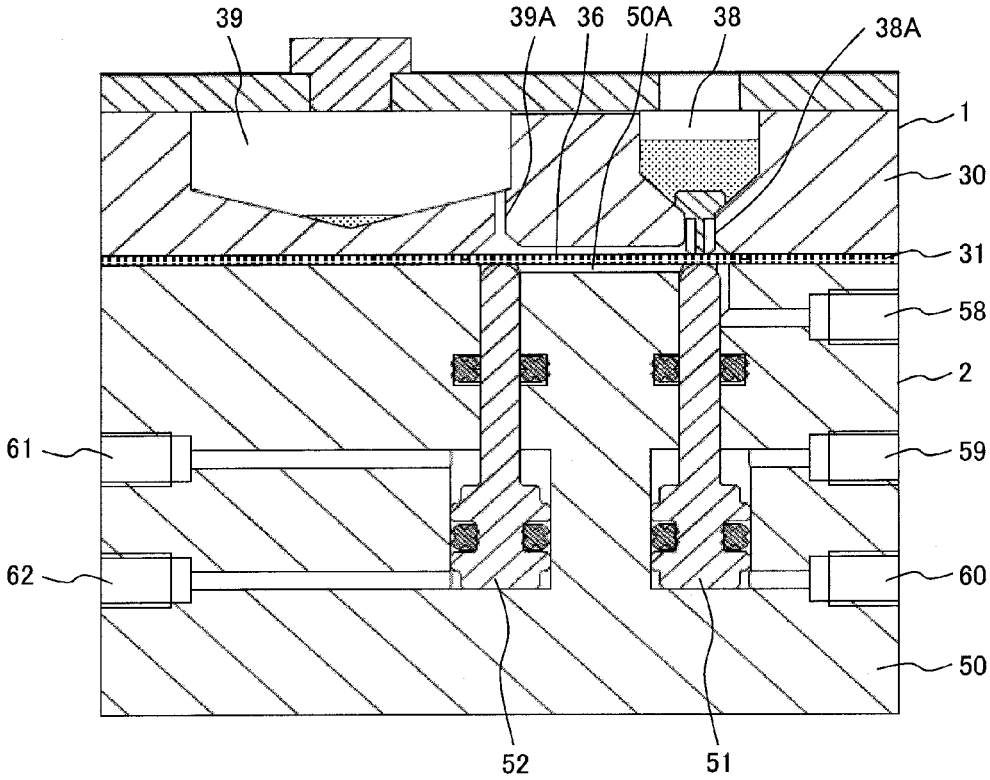
FIG. 6 is a longitudinal sectional view showing the initial state of the cartridge loaded on the cartridge holder.

As shown in FIG. 6, when the cartridge 1 is loaded on the cartridge holder 2, the sealing projection 57 of the cartridge holder body 50 crushes part of the membrane 31 and seals the surroundings of the liquid transport channel 36 as mentioned above. The air pressure port 60 is intended to push up the plunger 51. The air pressure port 59 is intended to move the plunger 51 back to its original position. The air pressure port 62 is intended to push up the plunger 52. The air pressure port 61 is intended to move the plunger 52 back to its original position. Each port is connected to a pipe from the air pressure control system 3. Consequently, the air pressure control system 3 supplies air pressure to each port and the plungers of the air cylinder mechanism are activated individually.

The air pressure port 58 supplies air pressure to an air pressure applying part 50A. This causes part of the membrane 31 to be deformed elastically and pressed against the liquid transport channel 36. A groove 50A, which is opposite to the liquid transport channel 36 across the membrane 31 when the cartridge 1 is loaded on the cartridge holder 2, is provided on the top surface of the cartridge holder body 50. This groove 50A is communicated with the air pressure port 58 and serves as the above air pressure applying part to deform part of the membrane 31 elastically. The groove 50A is surrounded by the projection 57. The air port 58 and groove 50A serve as an air supply/exhaust mechanism to give air pressure to reciprocate the membrane 31 as a pneumatic diaphragm pump mechanism.

Air pressure is not supplied to the cartridge holder 2 merely by connecting the pipes of the air pressure control system 3 to the air pressure ports. In the normal state, all the ports of the cartridge holder 2 are open to the atmosphere under the directional control by the three-way valves 14 (see FIG. 3).

Figure 2:
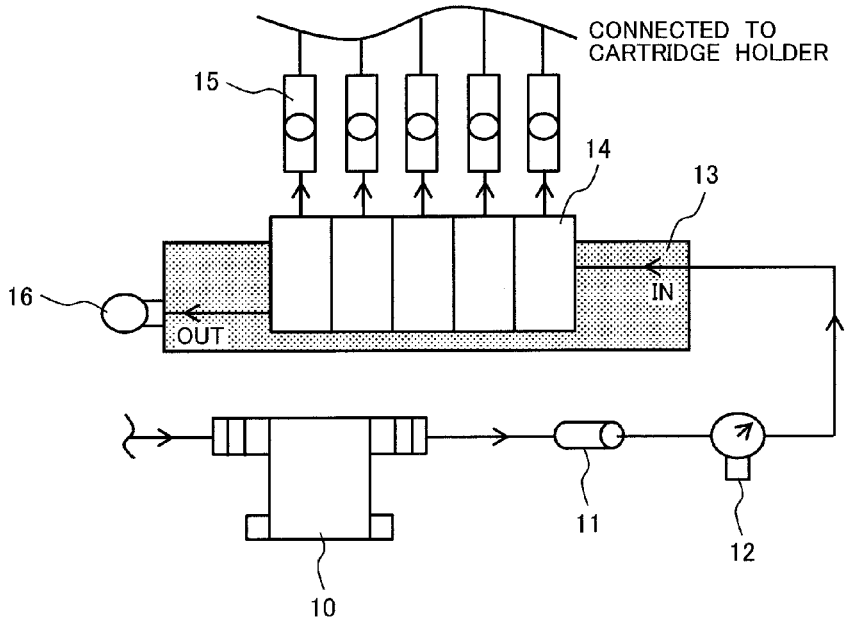
FIG. 2 is a structure diagram of an air pressure control system used in the above embodiment.

FIG. 2 shows the structure of the air pressure control system 3. The air pump 10 as an air pressure drive source sucks in and discharges air. The discharged air passes through a pipe and through an air filter 11 and an air pressure regulating valve 12 and is guided to the IN side of a three-way valve manifold 13. A plurality of three-way valves 14 are serially mounted on the three-way valve manifold 13 and each connected with a common air flow path. Each of the three-way valves 14 is connected to a pipe. The three-way valves 14 are controlled individually. When a three-way valve 14 is energized, the manifold 13 is connected to the cartridge holder 2 and the air from the air pump 10 passes through a speed controller 15 and is guided to the cartridge holder 2. The three-way valve manifold 14 also has an OUT side flow path for air exhaust which is open to the atmosphere. A silencer 16 is attached to the exit of the OUT side flow path.

As the air discharged from the air pump 10 passes through the air filter 11, dirt and dust contained in the air are removed. This prevents foreign matter from entering the three-way valves 14 and speed controllers 15. Also, the air pressure regulating valve 12 can regulate the air pressure given to the cartridge holder 2 to an appropriate pressure. Since the three-way valves 14 are mounted on the three-way valve manifold 13, all the pipes are connected at a single point. Even if the number of three-way valves 14 is increased, the pipes are connected at one point and thus they can be housed in a compact manner. A speed controller 15 is connected to the pipe connected to each three-way valve 14 so that the air pressure flow rate can be controlled. Here, since a liquid is transported pneumatically by reciprocating motion (pumping motion) of the membrane 31, flow rate control is important. Also, since a sound is made when the pipe with high pressure is made open to the atmosphere, the silencer 16 is provided on the OUT side exit to turn down the sound volume.

Figure 3:
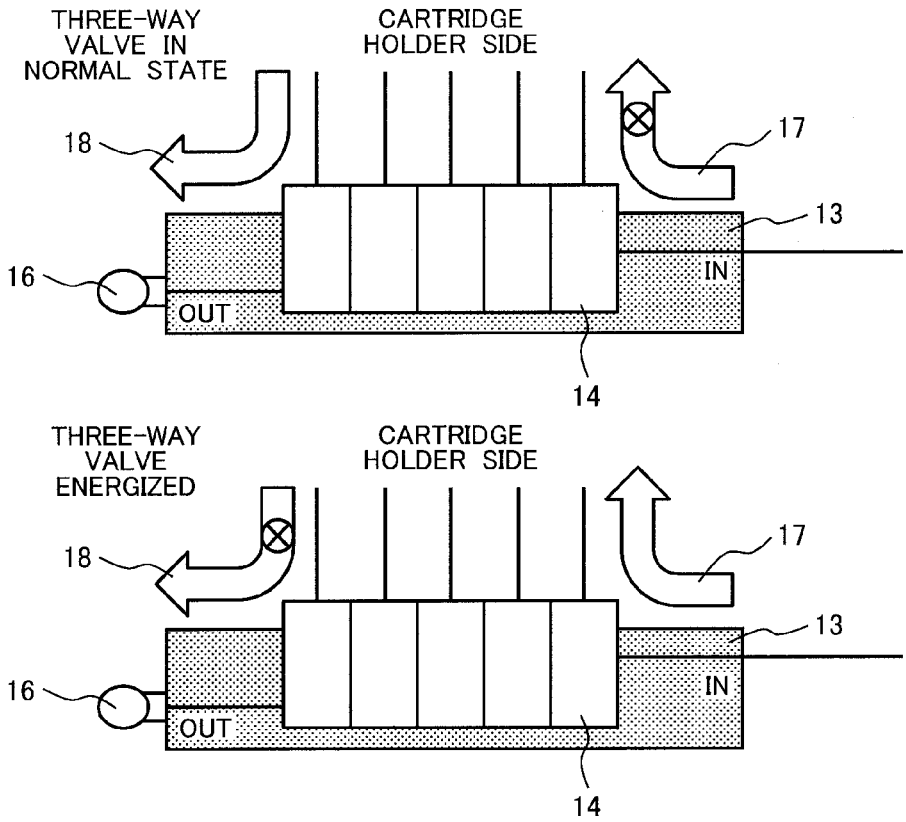
FIG. 3 is a diagram of direction control by three-way valves used in the air pressure control system in a normal state and an energized state.

FIG. 3 is a view which shows direction control by the three-way valves 14 of the air pressure control system 3.

The pipes are here arranged so that an air pressure flow path 17 extending from the IN side to the cartridge holder 2 and an air pressure flow path 18 extending from the cartridge holder 2 to the OUT side are each switched by the three-way valves 14. A three-way valve 14 is normally closed and in the normal state, the air pressure flow path 17 is closed and the air pressure flow path 18 is connected. At this time, the air coming from the IN side is connected to the three-way valve manifold 13, but the air pressure flow path 17 is closed, so no air pressure is applied to the cartridge holder 2. However, since the air pressure flow path 18 is open, the flow path on the cartridge holder 2 side and the OUT side are open to the atmosphere. When the three-way valve 14 is energized, the air pressure flow path 17 becomes open and the air pressure flow path 18 becomes closed. At this time, the air coming from the IN side is guided to the three-way valve manifold 13 and since the air pressure flow path 17 is open, the air can be transported to the cartridge holder 2. Also, since the air pressure flow path 18 is closed, the air pressure can be given to the cartridge holder 2. Since the pipes are connected to the cartridge holder 2 through the three-way valves 14, the air pressure can be given to a desired flow path.

Next, liquid transporting operation in the cartridge 1 with this structure will be explained referring to FIGS. 7 to 19. As a preparation for transporting a liquid, first, the air pump 10 is driven before connecting the cartridge holder 2 to the air pressure control system 3. At this time, since the three-way valves 14 are in the normal closed state, the pressure between the air pump 10 and the three-way valves 14 increases. In this condition, the pressure is regulated to an appropriate level by the pressure regulating valve 12. After that, each three-way valve 14 is energized to open the air pressure flow path 17 and close the air pressure flow path 18. Consequently, air is sent to the cartridge holder 2 through the pipe and in this condition, the flow rate in each pipe connected to the cartridge holder 2 is controlled by the speed controller 15. After regulation of the air pressure and flow rate is finished, the cartridge holder 2 is connected to the air pressure control system 3 and the cartridge 1 is loaded on the cartridge holder 2.

Figure 7:
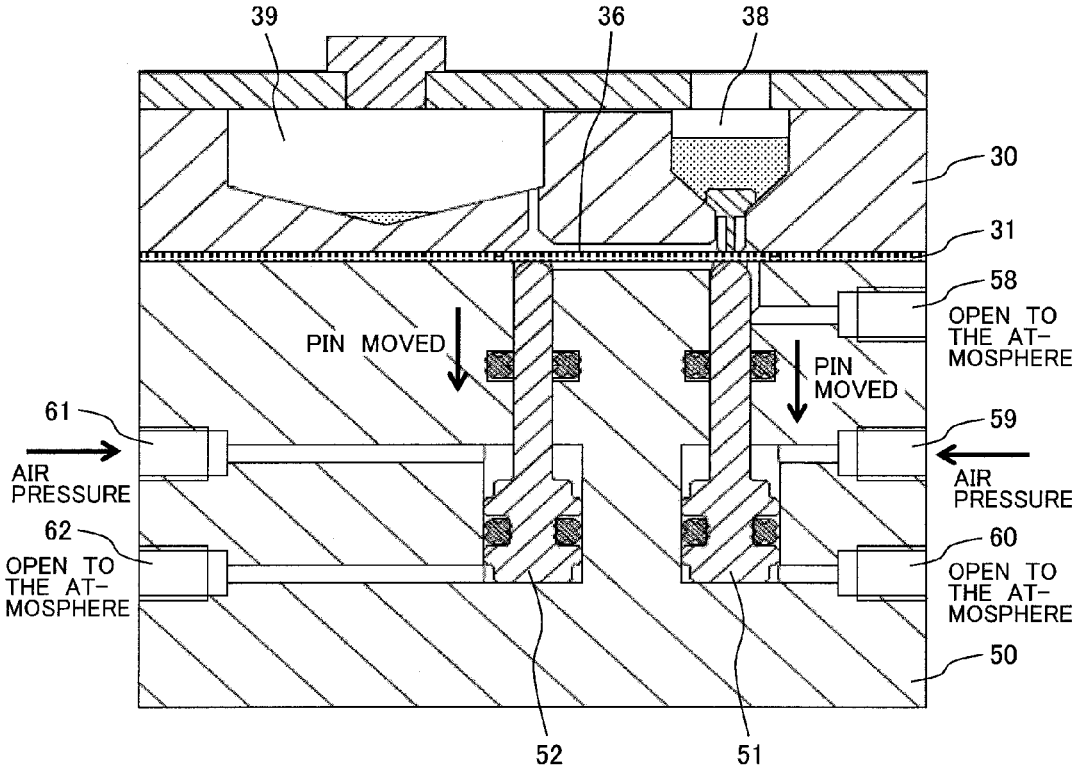
FIG. 7 is an explanatory view showing the cartridge and a cartridge operation sequence.
Figure 8:
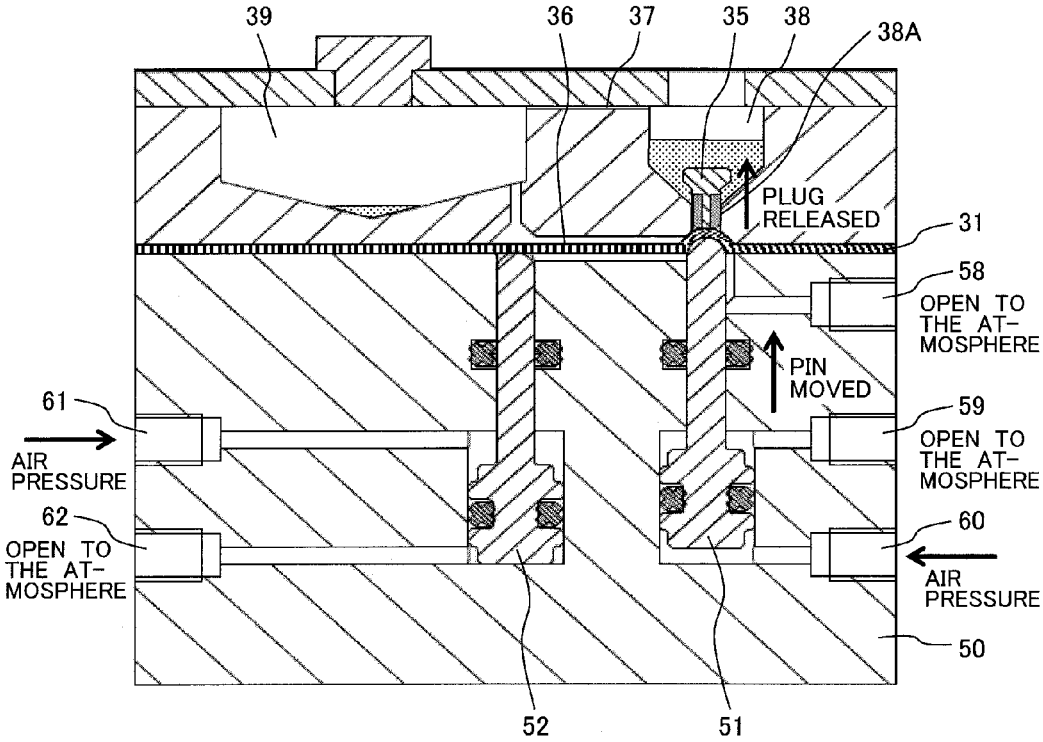
FIG. 8 is an explanatory view showing the cartridge and the cartridge operation sequence.

Then, first the three-way valve 14 of the air pressure port 59 and the three-way valve 14 of the air pressure port 61 are switched so that these ports are communicated with the air pressure supply side. Consequently, the plunger 51 and plunger 52 move down as shown in FIG. 7. This condition is considered to be the plunger initial position. Then, the three-way valve 14 of the air pressure port 60 is switched so that the air pressure port 60 is communicated with the air pressure supply side, and the three-way valve 14 of the air pressure port 59 is switched so that the air pressure port 59 is communicated with the atmosphere. Consequently, the air pressure accumulated in the air pressure port 59 becomes open to the atmosphere and the air pressure from the air pressure port 60 is applied, so the plunger 51 is pressed against the cartridge 1 by the air pressure as shown in FIG. 8. The plunger 51 pushes up the plug 35 closing the reagent encapsulating chamber 38 through the membrane 31. This releases the plug 35 closing the reagent encapsulating chamber 38. The plug 35 once released is kept pushed up so that it remains released after that. However, since the plunger 51 is held pressed between the reagent encapsulating chamber 38 and the liquid transport channel 36, the area between the reagent encapsulating chamber 38 and the liquid transport channel 36 remains closed.

Figure 9:
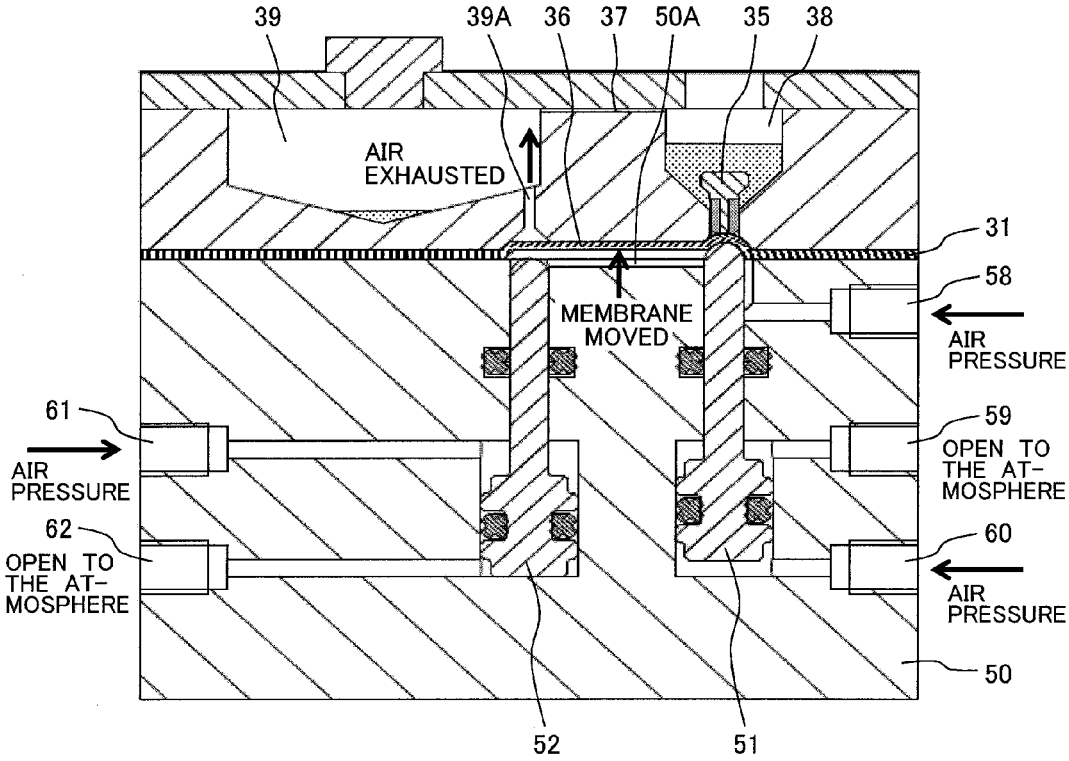
FIG. 9 is an explanatory view showing the cartridge and the cartridge operation sequence.

Then, the three-way valve 14 of the air pressure port 58 is switched so that the air pressure port 58 is communicated with the air pressure supply source. This causes air pressure to be introduced into the groove (air pressure applying part) 50A and part of the membrane 31 is pushed by the air pressure to contact the liquid transport channel 36, as shown in FIG. 9. Consequently, the air staying in the liquid transport channel 36 is pushed out into the sample encapsulating chamber 39. Meanwhile the pressure in the cartridge 1 goes up since the inside of the cartridge 1 is sealed. Between the reagent encapsulating chamber 38 and the sample encapsulating chamber 39, the vent groove 37 lies above the chambers, so the pressures in the chambers are equalized.

Figure 10:
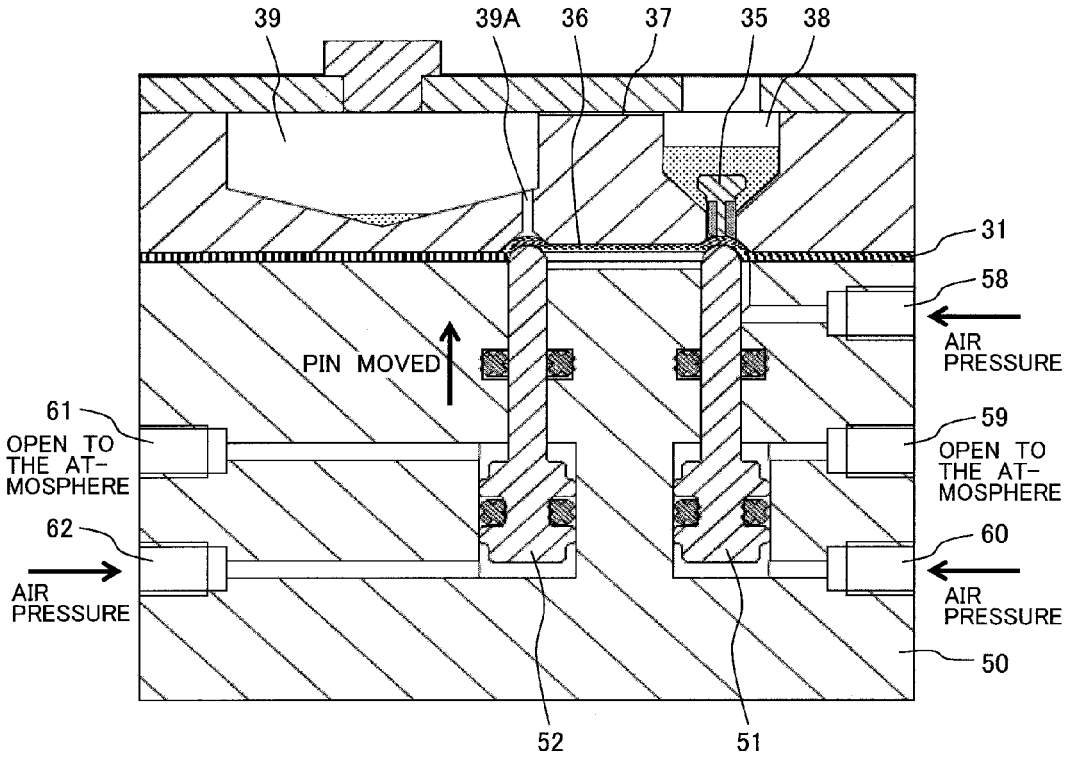
FIG. 10 is an explanatory view showing the cartridge and the cartridge operation sequence.

Then, the three-way valve 14 of the air pressure port 62 is switched so that the air pressure port 62 is communicated with the air pressure supply source and the three-way valve 14 of the air pressure port 61 is switched so that the air pressure port 61 is communicated with the atmosphere. Consequently, the air pressure accumulated in the air pressure port 61 becomes open to the atmosphere and since the air pressure from the air pressure port 62 is applied, the plunger 52 is pushed up toward the cartridge 1 by the air pressure as shown in FIG. 10. The plunger 52 is pressed between the sample encapsulating chamber 39 and the liquid transport channel 36 through the membrane 31, so the area between the sample encapsulating chamber 39 and the liquid transport channel 36 is closed.

Figure 11:
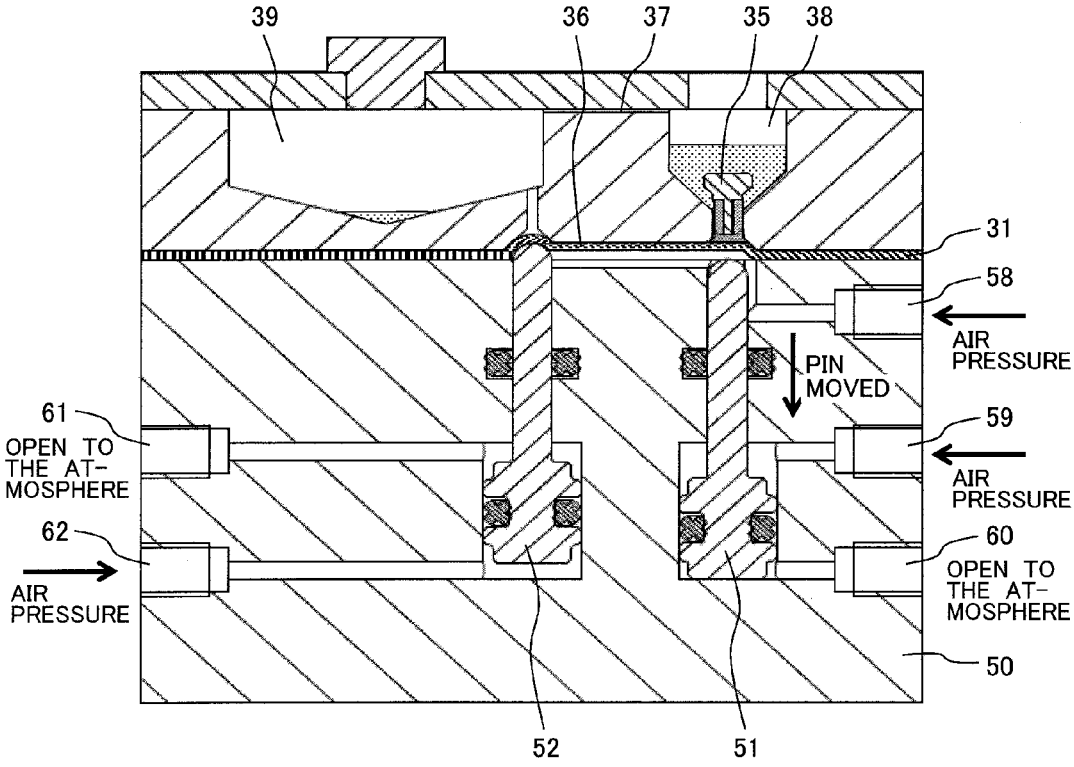
FIG. 11 is an explanatory view showing the cartridge and the cartridge operation sequence.

Then, the three-way valve 14 of the air pressure port 60 is switched so that the air pressure port 60 is communicated with the atmosphere and the three-way valve 14 of the air pressure port 59 is switched so that the air pressure port 59 is communicated with the air pressure supply source. Consequently, the air pressure accumulated in the air pressure port 60 becomes open to the atmosphere and since the air pressure from the air pressure port 59 is applied, the plunger 51 returns to its original position as shown in FIG. 11. The membrane 31 remains under the air pressure from the air pressure port 58, so it is held pressed against the liquid transport channel 36.

Figure 12:
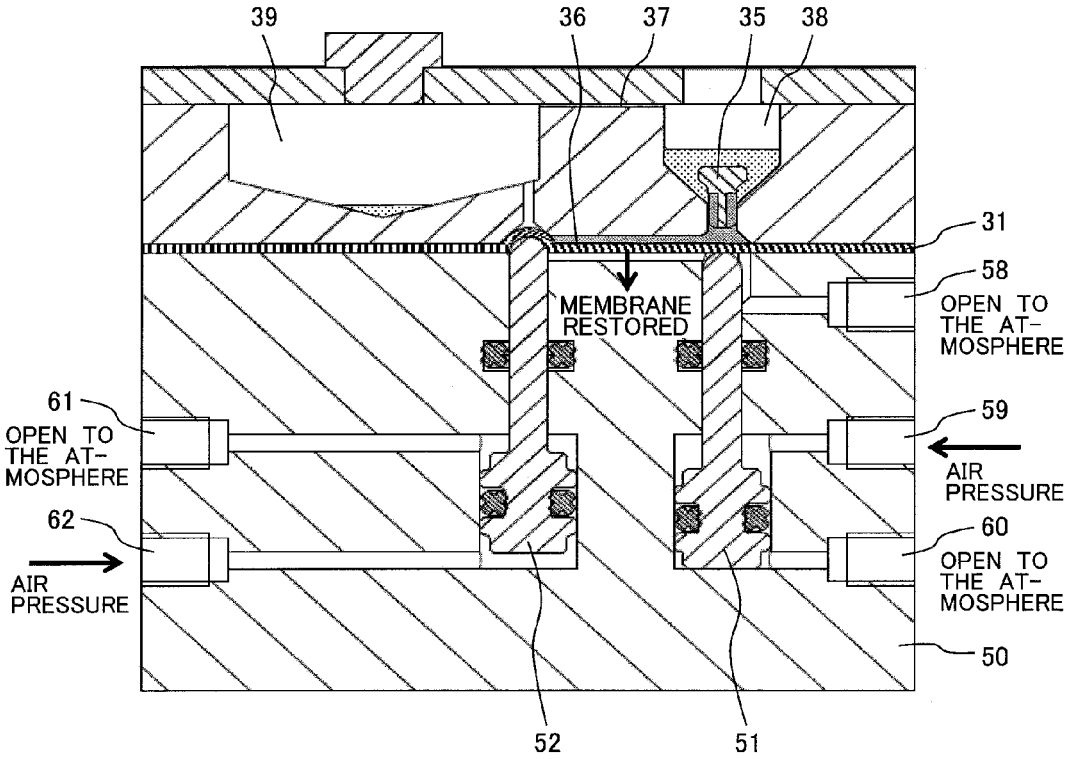
FIG. 12 is an explanatory view showing the cartridge and the cartridge operation sequence.

Then, the three-way valve 14 of the air pressure port 58 is switched so that the air pressure port 58 is communicated with the atmosphere. Consequently, the air pressure accumulated in the air pressure port 58 becomes open to the atmosphere and as shown in FIG. 12, the membrane 31 pressed against the liquid transport channel 36 is restored to its original position by its own elastic force and the pressure inside the cartridge 1. At that time, the plunger 52 forces the sample encapsulating chamber 39 and the liquid transport channel 36 to remain closed, so the reagent from the reagent encapsulating chamber 38 flows into the liquid transport channel 36 and the air from the sample encapsulating chamber 39 passes through the vent groove 37 and moves into the reagent encapsulating chamber 38.

Figure 13:
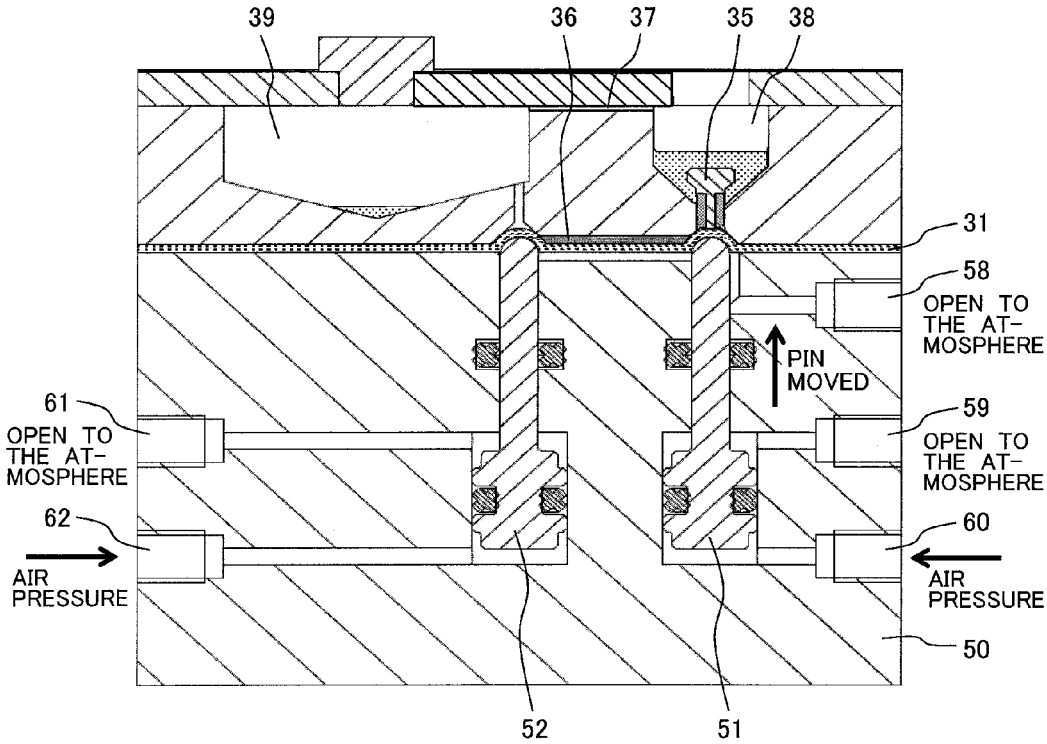
FIG. 13 is an explanatory view showing the cartridge and the cartridge operation sequence.

Then, the three-way valve 14 of the air pressure port 60 is switched so that the air pressure port 60 is communicated with the air pressure supply source and the three-way valve 14 of the air pressure port 59 is switched so that the air pressure port 59 is communicated with the atmosphere. Consequently, the air pressure accumulated in the air pressure port 59 becomes open to the atmosphere and the air pressure from the air pressure port 60 is applied, so the plunger 51 is again pressed against the cartridge 1 as shown in FIG. 13. At this time, again the plunger 51 closes the area between the reagent encapsulating chamber 38 and the liquid transport channel 36 but the reagent remains in the liquid transport channel 36.

Figure 14:
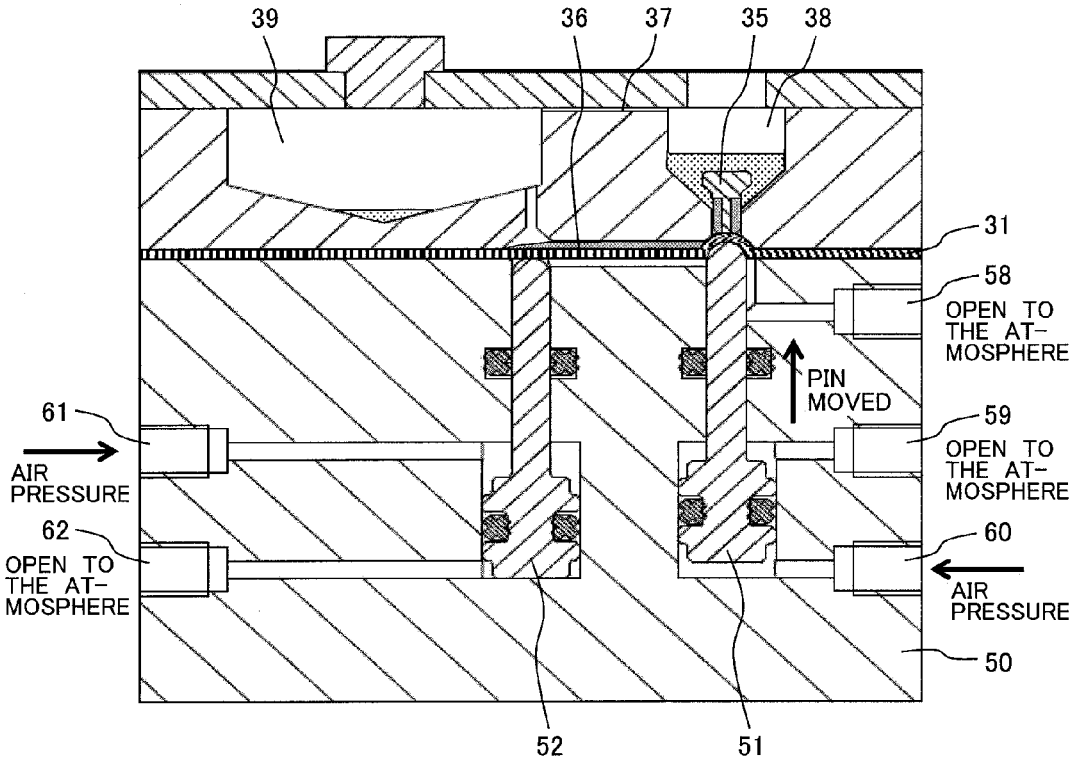
FIG. 14 is an explanatory view showing the cartridge and the cartridge operation sequence.

Then, the three-way valve 14 of the air pressure port 62 is switched so that the air pressure port 62 is communicated with the atmosphere and the three-way valve 14 of the air pressure port 61 is switched so that the air pressure port 61 is communicated with the air pressure supply source. Consequently, the air pressure accumulated in the air pressure port 62 becomes open to the atmosphere and the air pressure from the air pressure port 61 is applied, so the plunger 52 returns to its original position as shown in FIG. 14.

Figure 15:
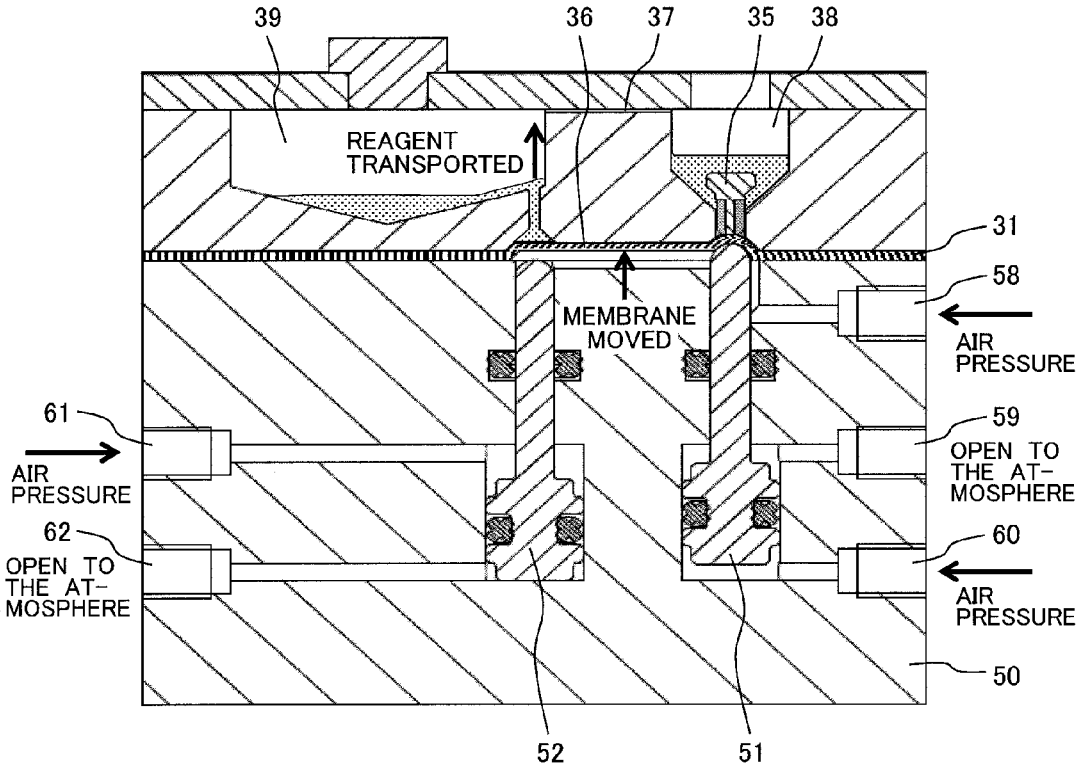
FIG. 15 is an explanatory view showing the cartridge and the cartridge operation sequence.

Then, again the three-way valve 14 of the air pressure port 58 is switched so that the air pressure port 58 is communicated with the air pressure supply source. Consequently, as shown in FIG. 15, the membrane 31 is pressed by the air pressure and forced to contact the liquid transport channel 36. At that time, the area between the reagent encapsulating chamber 38 and the liquid transport channel 36 is held closed by the plunger 51, so the reagent accumulated in the liquid transport channel 36 flows into the sample encapsulating chamber 39. As a result, the encapsulated sample is mixed with the reagent.

Figure 16:
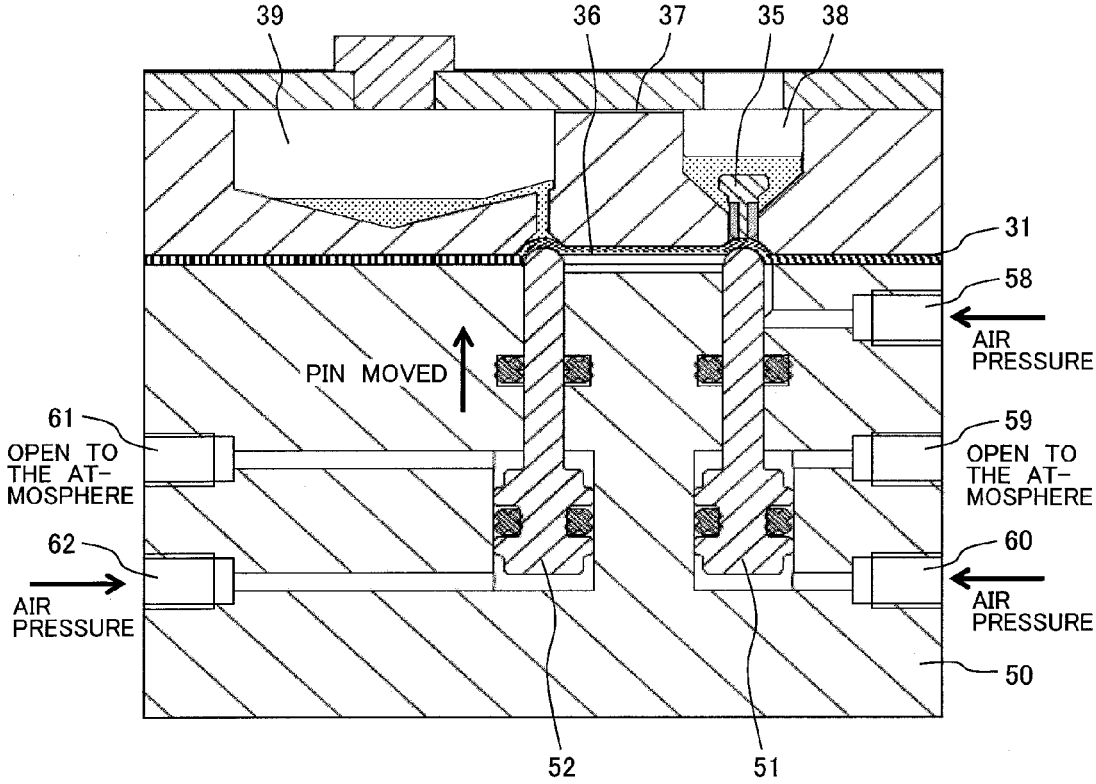
FIG. 16 is an explanatory view showing the cartridge and the cartridge operation sequence.

Then, again the three-way valve 14 of the air pressure port 61 is switched so that the air pressure port 61 is communicated with the atmosphere and the three-way valve 14 of the air pressure port 62 is switched so that the air pressure port 62 is communicated with the air pressure supply source. Consequently, the air pressure accumulated in the air pressure port 61 becomes open to the atmosphere and the air pressure from the air pressure port 62 is applied, so the plunger 52 is held pressed against the cartridge 1 as shown in FIG. 16. At this time, the plunger 52 closes the area between the sample encapsulating chamber 39 and the liquid transport channel 36.

As the operation shown in FIGS. 10 to 16 is repeated, the reagent encapsulated in the reagent encapsulating chamber 38 is transported to the sample encapsulating chamber 39. This makes it possible to transport a liquid in the sealed cartridge 1 without contact with a fluid. By repeating this operation a number of times, the entire reagent in the chamber can be transported, whether the amount of reagent is very small or large. However, after purification, reaction, etc., in some cases, not all the reagent in the chamber but only a given amount of reagent should be transported. In such a case, the given amount of reagent can be transported by controlling the number of repetitions of this operation.

More specifically, according to this embodiment, when the cartridge is loaded on the cartridge holder, the plungers are driven by air pressure control to seal or open the liquid transport port of each chamber. Furthermore, the membrane is pressed against the liquid transport channel by air pressure and the volume (shape) of the liquid transport channel can be changed by air pressure. Consequently, the liquid transport channel functions as a pump to move the fluid inside. By a combination of these movements, the liquid can be transported without contact with a fluid in the sealed cartridge.

This structure is given to each liquid transport channel between mutually related chambers among all the chambers of the cartridge 1 so that various reagents can be transported at a desired time by the same operation as above. In addition, when purification, reaction, or agitation is done, the area between chambers can be sealed arbitrarily and thus fluid control can be done stably.

In this embodiment, by supplying a prescribed amount of reagent to the sample encapsulating chamber 39, the sample is mixed with the reagent, and in the sample encapsulating chamber 39, the abovementioned pump function of the membrane 31 may be used for agitating.

For example, in a condition in which the reagent has been supplied to the sample encapsulating chamber 39 and the sample stays mixed with the reagent in the sample encapsulating chamber 39 (condition shown in FIG. 16), the liquid transport port 38A of the chamber connected to the sample encapsulating chamber 39 (which also serves as a agitating chamber) through the liquid transport channel 36 (the reagent encapsulating chamber 38 in this embodiment) is closed. In this condition, only the sample encapsulating chamber 39 is communicated with the liquid transport channel 36 and the reciprocating motion of the membrane 31 in the liquid transport channel 36 is repeated. The reciprocating motion of the membrane causes part of the liquid (sample-reagent mixture) in the sample encapsulating chamber 39 to be repeatedly pulled and pushed, back and forth, between the sample encapsulating chamber 39 and the liquid transport channel 36, so that the liquid in the sample encapsulating chamber 39 is agitated. Although the sample encapsulating chamber 39 also has the function as an agitating chamber in this embodiment, alternatively the above operation may be performed while a sample encapsulating chamber and a agitating chamber are separated from each other.

Consequently, reagent mixing, agitating, purification, reaction, etc. can be performed while contamination with DNA floating in the air is prevented.

In this embodiment, a series of processes from nucleic acid extraction to amplification are conducted in the cartridge, but instead, processes from nucleic acid extraction to purification may be performed in the cartridge.

There are many kinds of reagents required for preprocessing in gene analysis. In these circumstances, when this system is adopted, it can handle many reagents though the drive source is only the air pump 10 of the air pressure control system 3. In addition, even if another cartridge 1 is added to the device, by installing an additional three-way valve 14 and an additional pipe in this system, the system can work without an additional drive source. Therefore, the system may be considered to be a versatile system. Furthermore, the device cost can be reduced and the device can be more compact.

In this embodiment, the valve function for the liquid transport channel is given only by the membrane 31 in the cartridge 1 and the air cylinder mechanism to drive it is built in the cartridge holder 2, so the cartridge 1 itself can be structurally simplified. Since the cartridge 1 is disposable, reduction in the unit price of the cartridge 1 leads directly to reduction in running cost.

As an example of application of this embodiment, the valve function in this embodiment may be provided in the cartridge. For example, a check valve (one-way valve) may be installed at the point of sealing by a plunger in the cartridge so that the liquid transport channel is deformed by air pressure to transport the liquid. As methods for providing a built-in check valve, the following methods are available: a method which uses a commercial check valve and has it built in, a method which uses a rubber ball and gives it a check valve function, and a method in which a membrane is formed into a three-dimensional shape and two such membranes are pasted together. Consequently, the structure of the cartridge holder is simplified and the device cost can be reduced. However, since the check valve is built in the cartridge, the price of the cartridge is higher.

When the membrane makes up a pump mechanism based on air pressure as in this embodiment, the liquid can be transported while fluid control is easily done. As another example of application, instead of deforming the liquid transport channel 36 by air pressure, the chambers, including the reagent encapsulating chamber 38, may be deformed by air pressure. Instead of air pressure, a different thing such as a roller may be used for deformation.

According to this embodiment, the amount of transported liquid varies depending on how the membrane 31 is deformed. If the amount of liquid which can be transported by deforming the membrane 31 once is to be controlled, desirably the membrane 31 should be elastically deformed until it completely contacts the liquid transport channel 36. The amount of transported liquid can be controlled by changing the volume of the liquid transport channel 36 according to the amount of elastic deformation of the membrane 31.

Basically, the cartridge 1 is cryopreserved in order to suppress degradation in the previously encapsulated reagent. However, due to the existence of the vent hole 37, there is a possibility that the reagent may move into another chamber through the vent groove 37 when the cartridge is unfrozen. For this reason, after the cartridge is unfrozen, it must be handled carefully. On the other hand, a valve structure which opens the vent groove 37 only when positive or negative pressure is applied to the inside of the chamber of the cartridge 1 may be provided, in which the top cover 32 is an elastic molded article. Alternatively, it is also possible that the vent groove 37 is abolished and the inside of the chamber to which the liquid is first transported is kept pressurized and sealed to transport the liquid. As the liquid is transported, the inside of the chamber to which it is first transported is depressurized and the inside of the chamber to which it is transported next is pressurized. This helps deforming the membrane 31.

The plug 35 is used to seal the reagent chamber, etc. before its use and once unplugged, it loses the function as a plug. Here, when the plug 35 is slightly pushed up, the liquid transport channel 36 is made open. This means that the liquid transport channel can be made open without removing the plug 35 completely. It is also possible that the plug 35 is made of a material with low specific gravity such as polypropylene resin or EPDM and removed completely by the plunger (pin) force so as to float on the reagent. Alternatively, it may be made of a magnetic material and removed by the magnetic force; or it may be made of wax or the like and melted by heat; or it may be made into a fragile film or fragile shape so that its sealing part is broken and opened by the plunger force. Another possible approach is to make an attachment for storage of the cartridge and provide a structure which closes the reagent encapsulating chamber 38 and the liquid transport channel 36 while the cartridge is set in the attachment. In the first place, the plug 35 may be removed; in that case, the reagent may be put in a capsule to prevent the reagent from flowing into the liquid transport channel 36 during storage. The capsule may be melted by heat or the solvent to dissolve the capsule may be previously put in.

As for the three-way valves 14 of the air pressure control system 3, the air pressure port 58 and air pressure port 60 may be integrated. In that case, the motion to push up the plunger 51 and the motion to press the membrane 31 against the liquid transport channel 36 occur simultaneously, which poses no problem in transporting the liquid. Also, by using a spring to drive a plunger in a direction, the number of three-way valves 14 can be decreased. Here, when air pressure is given from the air pressure port 58 to press the membrane 31 against the liquid transport channel 36, a descending force is applied to the plungers 51 and 52. This force may be used to move down the plungers. This eliminates the need for the air pressure ports 59 and 61, so the number of three-way valves 14 can be further decreased. The number of three-way valves 14 can be decreased by adopting various methods as mentioned above to make the device more compact and reduce the device cost. In addition, the three-way valve manifold 13 and the cartridge holder body 50 may be integrated and by doing so, redundant pipes can be decreased to achieve more compactness and further cost reduction. Five-way valves may be used in place of the three-way valves 14.

In this technique, various processes can be conducted in the cartridge 1 by providing a temperature-controllable reaction chamber in the cartridge 1 in addition to the chamber for mixing the sample with the reagent and performing thermal control. Also when gene analysis is conducted using a capillary electrophoresis DNA sequencer, all preprocessing steps from DNA extraction to amplification are carried out in the cartridge 1 in advance and after preprocessing, the capillary is connected so that a series of processes for DNA analysis can be performed on a single device. The series of processes for DNA analysis includes PCR. Therefore, gene analysis such as expression analysis can also be made by conducting PCR with this technique and directly detecting PCR reaction optically.

Examples of the present invention have been so far explained, but the present invention is not limited thereto and it is understood by those skilled in the art that various modifications may be made within the scope of the present invention described in the claims. It is also within the scope of the present invention to combine embodiments as appropriate. In the above embodiment, nucleic acid, particularly DNA, has been described as an example of a living substance to which the present invention is applied, but it is not limited thereto but it is applicable to all living substances including RNA, proteins, polysaccharides, and microorganisms.

REFERENCE SIGNS LIST

1 . . . cartridge,
2 . . . cartridge holder,
3 . . . air pressure control system,
10 . . . air pump,
11 . . . air filter,
30 . . . cartridge body,
31 . . . membrane,
36 . . . liquid transport channel,
37 . . . vent groove
38 . . . reagent encapsulating chamber,
39 . . . sample (liquid reagent) encapsulating chamber,
50 . . . cartridge holder body,
50A . . . air pressure applying part,
51, 52 . . . air cylinder plungers,
57 . . . sealing projection,
58, 59, 60, 61, 62 . . . air pressure ports

The invention claimed is:

1. A cartridge able to be mounted on a cartridge holder having a plurality of extendable plungers, the cartridge comprising:

a cartridge body having a top side and a bottom side, and a plurality of chambers formed in the cartridge body, including a first chamber and a second chamber;

a top cover mounted on the top side of the cartridge body, the top cover including a resealable access port over the second chamber for enabling a sample to be deposited into the second chamber;

a first channel formed on the bottom side of the cartridge body, the first channel extending between an opening of the first chamber and an opening of the second chamber to enable liquid communication between the first chamber and the second chamber;

a vent formed on the top side of the cartridge body or in the top cover and extending between the second chamber and the first chamber to enable venting between the second chamber and the first chamber;

an elastic membrane attached to the bottom side of the of the cartridge body overlying the opening of the first chamber, the opening of the second chamber and the first channel; and a plug positioned in the opening of the first chamber so that, when the cartridge is mounted on the cartridge holder, the plug is positioned to be contacted by extension of a first one of the extendable plungers, the plug being movable within the opening of the first chamber to unseal, at least in part, the opening of the first chamber, wherein:

following contact of the first plunger with the plug, the elastic membrane is positioned by the extension of the first plunger to prevent liquid from leaving the first chamber until the first plunger is retracted; and the elastic membrane overlying the first channel is movable toward and away from the bottom side of the cartridge body to pump liquid from the first chamber to the second chamber in coordination with extension and retraction of the first plunger and a second plunger.

2. The cartridge according to claim 1, wherein the second chamber and the first chamber are shielded from an external air by the membrane and by the top cover, and connected to each other through the first channel and the vent.

3. The cartridge according to claim 1, wherein the plug is constructed of a material that causes the plug to float in a liquid in the first chamber following contact of the plug by the first plunger.

4. The cartridge according to claim 1, further comprising a reagent in the first chamber, wherein a port to the first chamber formed in the top cover is sealed from the outside following addition of the reagent into the first chamber.

5. The cartridge according to claim 1, further comprising:

a third chamber formed in the cartridge body; and a second channel extending between the second chamber and the third chamber to enable liquid communication between the second chamber and the third chamber.

6. The cartridge according to claim 5, wherein the cartridge body further comprises a fourth chamber, a fifth chamber, a sixth chamber, a seventh chamber, and an eighth chamber formed in the cartridge body, wherein:

a third channel connects the fourth chamber to the third chamber;

a fourth channel connects the fifth chamber to the third chamber;

a fifth channel connects the sixth chamber to the eighth chamber;

a sixth channel connects the eighth chamber to the third chamber; and a seventh channel connects the third chamber to the seventh chamber.

7. A biochemical processing device comprising:

a cartridge including:

a cartridge body having a top side and a bottom side, and a plurality of chambers formed in the cartridge body, including a first chamber and a second chamber;

a top cover mounted on the top side of the cartridge body;

a first channel formed on the bottom side of the cartridge body, the first channel extending between an opening of the first chamber and an opening of the second chamber to enable liquid communication between the first chamber and the second chamber;

an elastic membrane attached to the bottom side of the of the cartridge body overlying the opening of the first chamber and the first opening of the second chamber and the first channel; and a plug positioned in the opening of the first chamber to initially seal the first chamber, the plug being movable within the opening of the first chamber to unseal, at least in part, the opening of the first chamber;

a cartridge holder configured to hold the cartridge, the cartridge holder including a plurality of extendable plungers and an air pressure applying part; and an air supply/exhaust mechanism connected to an air pressure source to control a supply of air pressure to the cartridge holder, wherein:

when the cartridge is mounted on the cartridge holder, the plug is positioned to be contacted by extension of a first one of the extendable plungers, the plug being movable within the opening of the first chamber to unseal, at least in part, the opening of the first chamber;

following contact of the first plunger with the plug, the elastic membrane is positioned by the extension of the first plunger to prevent liquid from leaving the first chamber until the first plunger is retracted; and the elastic membrane overlying the first channel is movable toward and away from the bottom side of the cartridge body to pump liquid from the first chamber to the second chamber in coordination with extension and retraction of the first plunger and a second plunger.

8. The biochemical processing device according to claim 7, wherein the cartridge holder includes an air cylinder mechanism to control movement of the plurality of plungers for controlling movement of liquid through the cartridge.

9. The biochemical processing device according to claim 7, wherein the air supply/exhaust mechanism applies positive pressure or negative pressure to the elastic membrane to cause movement of the elastic membrane toward and away from the bottom side of the cartridge body.

10. The biochemical processing device according to claim 7, wherein the cartridge further comprises a vent formed on the top side of the cartridge body or in the top cover and extending between the first chamber and the second chamber to enable venting between the first chamber and the second chamber.

11. The biochemical processing device according to claim 7, wherein the cartridge holder further comprises the plurality of plungers positioned to align with respective openings of the plurality of chambers when the cartridge is mounted on the cartridge holder.

12. The biochemical processing device according to claim 7, wherein the wherein the cartridge body further comprises:

a third chamber formed in the cartridge body; and a second channel extending between the second chamber and the third chamber to enable liquid communication between the second chamber and the third chamber.

13. A biochemical processing device comprising:

a cartridge including:

a cartridge body having a top side and a bottom side, and a plurality of chambers formed in the cartridge body, including a first chamber, a second chamber, and a third chamber;

a top cover mounted on the top side of the cartridge body;

a first channel formed on the bottom side of the cartridge body, the first channel extending between an opening of the first chamber and an opening of the second chamber to enable liquid communication between the first chamber and the second chamber;

a second channel extending between the second chamber and the third chamber to enable liquid communication between the second chamber and the third chamber;

an elastic membrane attached to the bottom side of the of the cartridge body overlying the opening of the first chamber, the opening of the second chamber, and the first channel; and a plug positioned in the opening of the first chamber to initially seal the first chamber, the plug being movable within the opening of the first chamber to unseal, at least in part, the opening of the first chamber;

a cartridge holder configured to hold the cartridge, the cartridge holder including a plurality of extendable plungers and an air pressure applying part; and an air supply/exhaust mechanism connected to an air pressure source to control a supply of air pressure to the cartridge holder, wherein:

when the cartridge is mounted on the cartridge holder, the plug is positioned to be contacted by extension of a first one of the extendable plungers, the plug being movable within the opening of the first chamber to unseal, at least in part, the opening of the first chamber;

following contact of the first plunger with the plug, the elastic membrane is positioned by the extension of the first plunger to prevent liquid from leaving the first chamber until the first plunger is retracted; and the elastic membrane overlying the first channel is movable toward and away from the bottom side of the cartridge body to pump liquid from the first chamber to the second chamber in coordination with extension and retraction of the first plunger and a second plunger.

14. The biochemical processing device according to claim 13, wherein the cartridge body further comprises a fourth chamber, a fifth chamber, a sixth chamber, a seventh chamber, and an eighth chamber formed in the cartridge body, wherein:

a third channel connects the fourth chamber to the fifth chamber;

a fourth channel connects the fifth chamber to the third chamber;

a fifth channel connects the sixth chamber to the eighth chamber;

a sixth channel connects the eighth chamber to the third chamber; and a seventh channel connects the third chamber to the seventh chamber.

* * * * *